US005092506A

United States Patent [19]

Bolduc

[11] Patent Number: 5,092,506

[45] Date of Patent: Mar. 3, 1992

[54] SKATEBOARD CARRIER

[76] Inventor: Carmel G. Bolduc, 11126 Clark Rd., Houston, Tex. 77076

[21] Appl. No.: 610,162

[22] Filed: Nov. 5, 1990

[51] Int. Cl.[5] ..... A45F 3/04

[52] U.S. Cl. ..... 224/209; 224/191; 224/264; 224/901

[58] Field of Search ..... 224/209, 701, 917, 191, 224/264

[56] References Cited

U.S. PATENT DOCUMENTS

| | | | |
|---|---|---|---|
| 3,339,607 | 9/1967 | Howard | 224/309 |
| 4,553,779 | 11/1985 | Shortridge | 224/917 |
| 4,790,460 | 12/1988 | Harper, Jr. | 224/209 |

FOREIGN PATENT DOCUMENTS

| | | | |
|---|---|---|---|
| 2635693 | 3/1990 | France | 224/209 |

OTHER PUBLICATIONS

Sling, Velcro Product News, Jun. 1978, PN No. 46, available from Rainbow Blase Co.

Skateshing, Rainbow Blaze Advertisement, Skateboarder, Jan. 1978, vol. 4, No. 6.

*Primary Examiner*—Linda J. Sholl
*Attorney, Agent, or Firm*—Leon Gilden

[57] ABSTRACT

An organization wherein a central web includes a right and left wing portion, with the right and left wing portions secured relative to one another to contain a skateboard member therewithin. An upper and lower opening permits directing of the forward and rear wheel support plates of the skateboard to project therethrough. Cooperative hook and loop fastener strips are formed to the right and left edges of the respective right and left wings to permit securement of the wings relative to one another in an overlying relationship relative to the skateboard. A pocket is formed integrally to the bottom of the web to contain the forward end of the skateboard therewithin. Optionally, a plurality of pneumatic chambers may be mounted to the skateboard to enhance comfort to an individual supporting the organization as a backpack type unit.

1 Claim, 4 Drawing Sheets

PRIOR ART

FIG 3
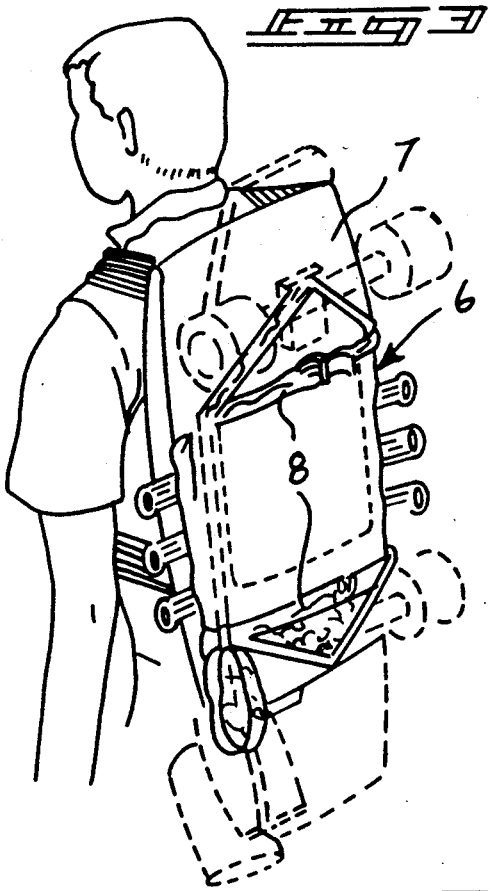
PRIOR ART
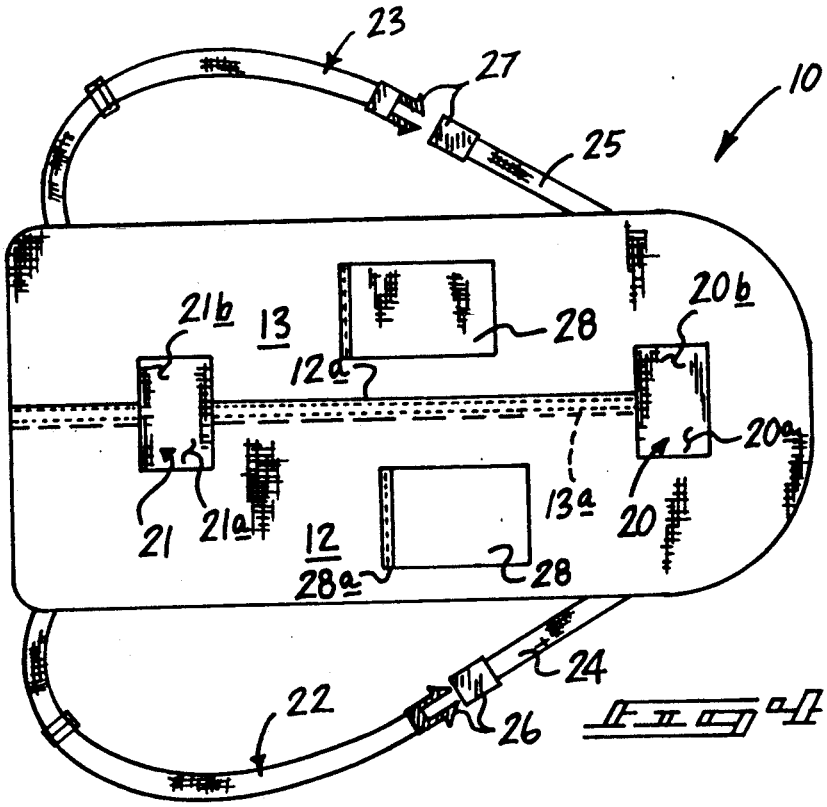
FIG 4

23
10
25
13
13a
11a
15
28
19
18
16
17
11
24
12a
12
14
22

23
27

25
12a
28
18
17
21
19
20
28
24
26
22

SKATEBOARD CARRIER

BACKGROUND OF THE INVENTION

1. Field of the Invention

The field of invention relates to skateboard carriers, and more particularly pertains to a new and improved skateboard carrier wherein the same conveniently and readily mounts a skateboard therewithin for ease of transport.

2. Description of the Prior Art

Skateboard carriers and organizations of various types for transport and portage of equipment is known in the prior art. Heretofore, however, a unit setting forth ease of comfort and completely enclosing a skateboard member to protect the member from weather and other elements and of compact and convenient construction has heretofore not been provided, as set forth by the instant invention. An example may be found in Harper, Jr. U.S. Pat. No. 4,790,460 wherein a transport carrier includes a plurality of straps to overlie and mount a skateboard, with the carrier including a coextensive cushion formed within the carrier to provide comfort to an individual transporting the skateboard.

Pate U.S. Pat. No. 4,337,883 sets forth a skateboard carrier, including a right and left leg overlapped relative to one another to encompass a skateboard underlying the forward wheels, with loop portions arranged to receive a belt therethrough for transport of the skateboard about a torso of an individual.

Comeau U.S. Pat. No. 4,693,402 sets forth a sport pack, wherein a backpack arrangement utilizes various packets for transport of various components therewithin, such as a baseball bat, baseball glove and the like.

As such, it may be appreciated that there continues to be a need for a new and improved skateboard carrier as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of skateboard carriers now present in the prior art, the present invention provides a skateboard carrier wherein the same provides a web construction to encompass and secure a skateboard body portion for transport thereof. As such, the general purpose of the present invention, which will be described subsequently in greater detail, is to provide a new and improved skateboard carrier which has all the advantages of the prior art skateboard carriers and none of the disadvantages.

To attain this, the present invention provides an organization wherein a central web includes a right and left wing portion, with the right and left wing portions secured relative to one another to contain a skateboard member therewithin. An upper and lower opening permits directing of the forward and rear wheel support plates of the skateboard to project therethrough. Cooperative hook and loop fastener strips are formed to the right and left edges of the respective right and left wings to permit securement of the wings relative to one another in an overlying relationship relative to the skateboard. A pocket is formed integrally to the bottom of the web to contain the forward end of the skateboard therewithin. Optionally, a plurality of pneumatic chambers may be mounted to the skateboard to enhance comfort to an individual supporting the organization as a backpack type unit.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determined quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved skateboard carrier which has all the advantages of the prior art skateboard carriers and none of the disadvantages.

It is another object of the present invention to provide a new and improved skateboard carrier which may be easily and efficiently manufactured and marketed.

It is a further object of the present invention to provide a new and improved skateboard carrier which is of a durable and reliable construction.

An even further object of the present invention is to provide a new and improved skateboard carrier which is susceptible of a low cost of manufacture with regard to both materials and labor, and which accordingly is then susceptible of low prices of sale to the consuming public, thereby making such skateboard carriers economically available to the buying public.

Still yet another object of the present invention is to provide a new and improved skateboard carrier which provides in the apparatuses and methods of the prior art some of the advantages thereof, while simultaneously overcoming some of the disadvantages normally associated therewith.

Still another object of the present invention is to provide a new and improved skateboard carrier wherein the same encompasses the skateboard in a wholly contained manner for protection and transport of the skateboard during periods of nonuse.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of a further example of a prior art skateboard member.

FIG. 4 is a top orthographic view of the instant invention.

DESCRIPTION OF THE PREFERRED EMBODIMENT

Figure 1:
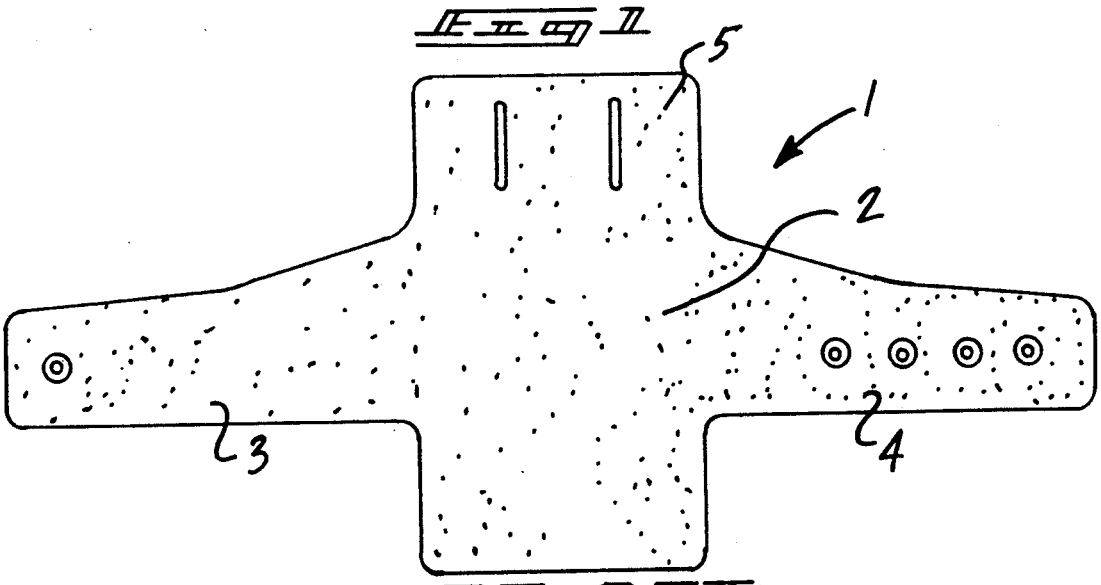
FIG. 1 is a top orthographic view of a prior art skateboard carrier organization.

With reference now to the drawings, and in particular to FIGS. 1 to 8 thereof, a new and improved skateboard carrier embodying the principles and concepts of the present invention and generally designated by the reference numeral 10 will be described.

Figure 2:
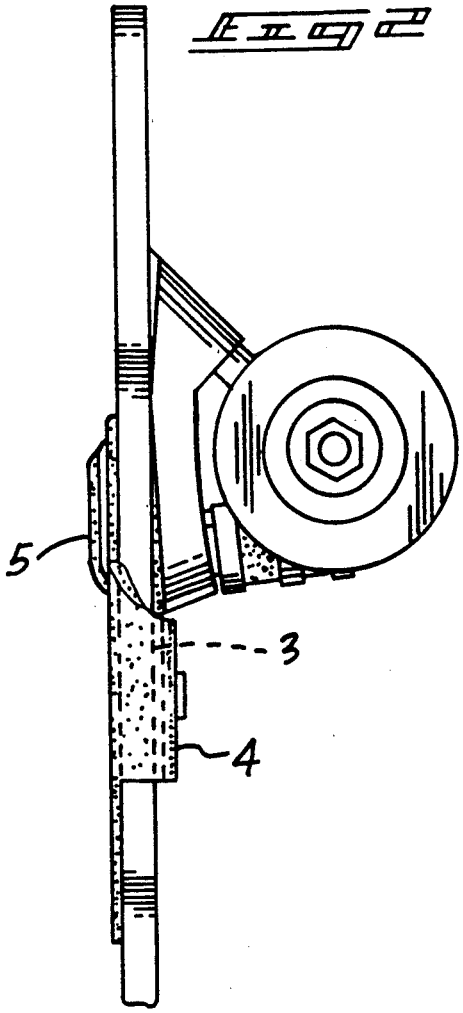
PRIOR ART FIG 2
FIG. 2 is an orthographic side view of the skateboard carrier of FIG. 1 secured to an associated skateboard.

FIG. 1 illustrates a prior art skateboard carrier organization 1, where a central web 2 includes a left and right leg 3 and 4 arranged for mounting about a skateboard member, as illustrated in FIG. 2, utilizing fastener elements. An upper leg 5 includes a plurality of slots for receiving a belt therethrough to permit torso mounting of the organization for transport thereof, as set forth in U.S. Pat. No. 4,337,883. FIG. 3 illustrates a prior art skateboard organization 6, wherein a skateboard 7 is mounted within a carrier that includes upper and lower parallel straps 8 for securement of the skateboard, in a manner as set forth in U.S. Pat. No. 4,790,460.

Figure 5:
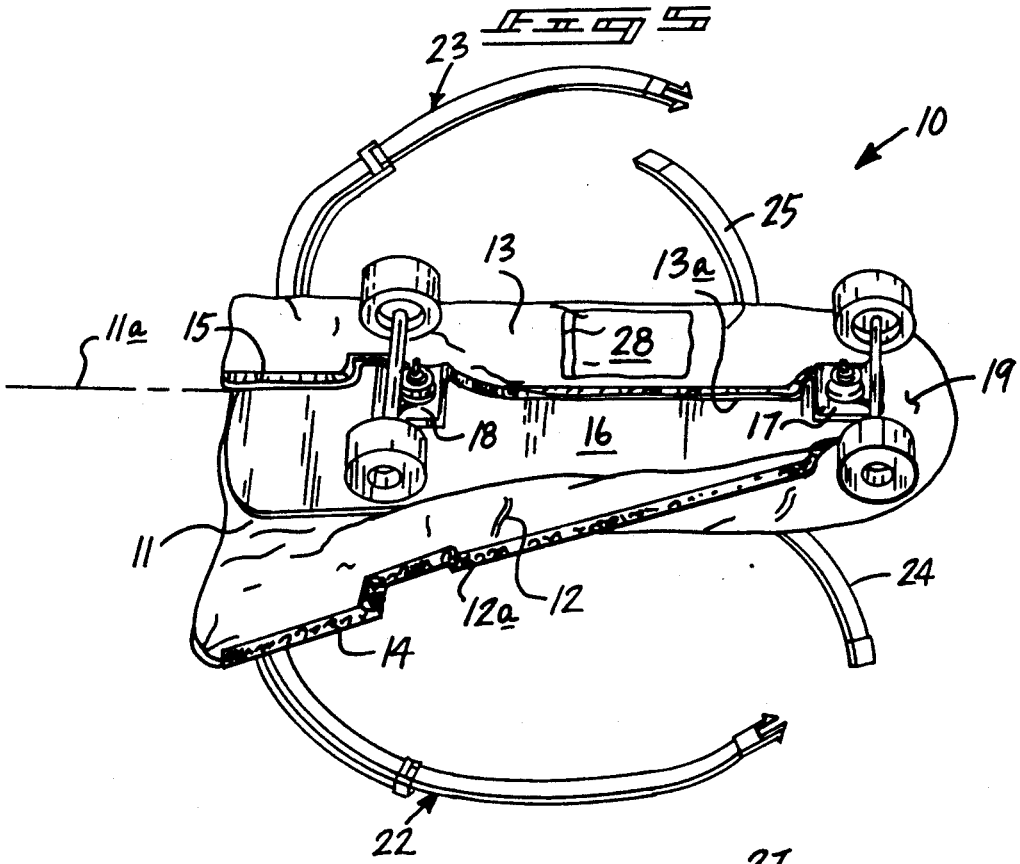
FIG. 5 is an isometric illustration of the instant invention receiving a skateboard therewithin.
Figure 6:
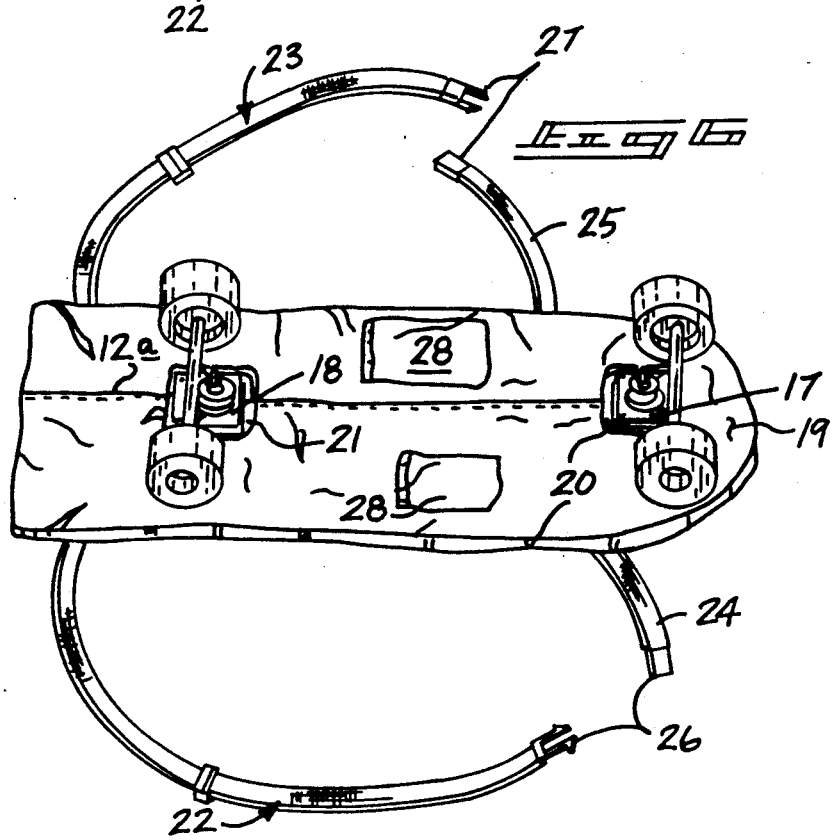
FIG. 6 is an isometric illustration of the instant invention encompassing an associated skateboard.

More specifically, the skateboard carrier 10 of the instant invention essentially comprises a central web 11 defined along a central axis 11*a* and symmetrically thereabout, with a length substantially equal to the length of an associated skateboard body 16. Mounted coextensively of the central web are a right and left wing portion 12 and 13, each including a respective right and left wing edge 12*a* and 13*a* that extend from the upper edge of the central web 11 in each wing downwardly to a lower opening 20 to define a lower pocket 19 to receive a forward terminal end of the skateboard. An upper opening 21 is positioned along the right and left wing edges 12*a* and 13*a* spaced above the lower opening 20. The lower opening 20 includes a lower right and lower recess 20*a* and 20*b* respectively formed at lower terminal ends of the right and left wing edges 12*a* and 13*a* when the edges are secured together, in a manner to be discussed below. Similarly, the upper opening 21 includes an upper right and left recess 21*a* and 21*b* cooperative and aligned together to form the upper opening 21 when the edges 12*a* and 13*a* are secured together. As illustrated in FIG. 5 for example, the use of right and left respective hook and loop fastener strips 14 and 15 mounted coextensively along the right and left wing edges 12*a* and 13*a* are securable together to wholly contain the skateboard body 16 of an associated skateboard. In this manner, the forward and rear wheel support plates 17 and 18 respectively project through the respective lower and upper openings 20 and 21 formed by aforenoted recesses. Mounted to the central web 11 is an adjustable right upper belt 22 and an adjustable left upper belt 23. The upper belts are respectively securable to a respective right and left lower belt 24 and 25 mounted to lowermost portions of the central web 11. A respective right and left buckle assembly 26 and 27 secure the belts together to provide a plurality of loops to permit an individual to direct their arms therethrough for transport of the organization upon the back of an individual's torso portion, in a manner similar to the prior art as set forth in FIG. 3. If desired, pockets 28 may be mounted to exterior surfaces of each of the right and left wing portions 12 and 13 utilizing pocket hook and loop fastener strips 28*a* to enclose the pockets for transport of various items therewithin.

Figure 7:
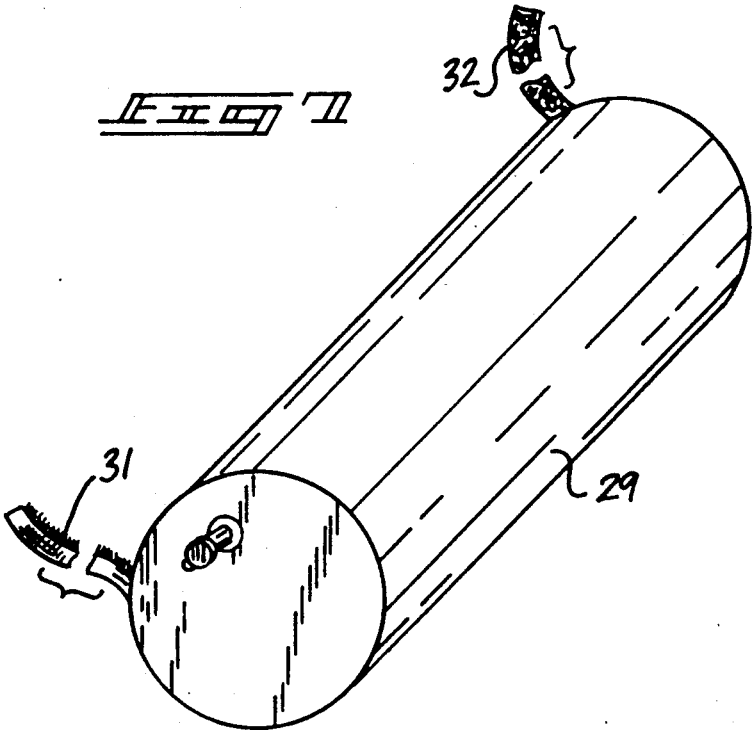
FIG. 7 is an isometric illustration of an optional pneumatic chamber utilized by the instant invention.
Figure 8:
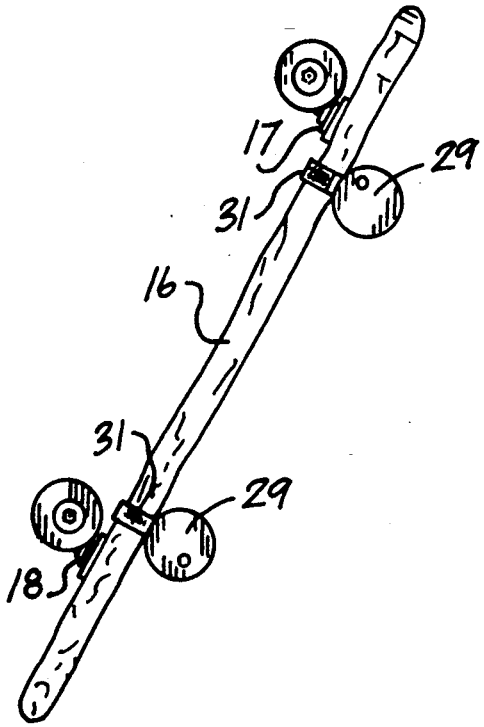
FIG. 8 is an orthographic side view, taken in elevation, of a plurality of pneumatic chambers mounted to a skateboard for use in association with the covering, as illustrated in FIGS. 4–6.

FIGS. 7 and 8 set forth the use of optionally provided inflation chambers 29. A plurality of such chambers are provided and are of a length substantially equal to the width of the skateboard body 16. Each inflation chamber 29 includes an inflation valve 30 to permit an individual to inflate each chamber to a desired pressure level. In this manner, the chambers 29 are orthogonally mounted to the skateboard body 16 orthogonally oriented relative to a longitudinal axis thereof utilizing cooperative first and second hook and loop fastener strap members 31 and 32 that are mounted to a respective opposed end of each elongate inflation chamber 29. Accordingly, the inflation chambers 29 are mounted to a top surface of the skateboard body 16 prior to positioning upon the central web 11. In this manner, comfort is afforded to an individual when the assembly is mounted on an individual's back.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A skateboard carrier in combination with a skateboard, wherein the skateboard includes an elongate skateboard body defined by a predetermined length, and the skateboard body includes a forward wheel support plate and a rear wheel support plate longitudinally aligned medially of the skateboard body, each including a plurality of wheels mounted thereto, wherein the carrier comprises, an elongate longitudinally aligned central web, the central web defined by the predetermined length, and the central web including a right wing portion and a left wing portion extending laterally of the central web and coextensively thereof from an upper end of the central web to a lower position, wherein the lower position is spaced from a lower end of the central web to define a lower pocket formed orthogonally relative to a central web central axis that extends longitudinally of the central web, and the right wing portion including a right wing edge and the left wing portion including a left wing edge, wherein the right wing edge includes a right hook and loop fastener strip and the left wing edge includes a left hook and loop fastener strip for securement of the right and left fastener strips together, and the right wing edge includes a lower right recess and an upper right recess, and the left wing edge includes a lower left recess and an upper left recess, wherein the lower right recess and the left recess are positioned adjacent relative to one another when the right and left wing edges are secured together, and the upper right recess and the upper left recess are aligned relative to one another when the right and left wing edges are secured together to permit projection of the forward wheel support plate through the lower right recess and the lower left recess and projection of the right wheel support plate when the upper right recess and the upper left recess are secured together, and wherein the lower right recess and the lower left recess define a lower opening when the right wing edge and the left edge are secured together and the upper right recess and the upper left recess define an upper opening when the right and left wing edges are secured together, wherein the lower opening and the upper opening are spaced apart a predetermined spacing defined between the forward wheel support plate and the rear wheel support plate, and including an adjustable right belt and an adjustable left belt mounted in a central web to define a respective right and left loop for securement of the carrier about right and left shoulders of an individual, and including a plurality of inflation chambers, each inflation chamber is defined by an inflation chamber length substantially equal to a predetermined width of the skateboard body, and each inflation chamber includes an inflation valve in operative association therewith to permit inflation of each inflation chamber to a predetermined pressure, and each inflation chamber includes a first hook and loop strap mounted to a first end of each inflation chamber, and a second hook and loop strap member mounted to an opposed second end of each inflation chamber, wherein the first and second hook and loop strap members are secured together for securement of each inflation chamber to the skateboard body to provide cushioning of the skateboard body when the skateboard body is mounted onto the central web and the right and left wing portions are secured together.

* * * * *